US007476184B1

(12) United States Patent
Batca

(10) Patent No.: US 7,476,184 B1
(45) Date of Patent: Jan. 13, 2009

(54) EXERCISE MACHINE WITH INDEPENDENTLY ADJUSTABLE ARMS

(76) Inventor: Roger Batca, 3102 Shaftsbury St., Durham, NC (US) 27704

( * ) Notice: Subject to any disclaimer, the term of this patent is extended or adjusted under 35 U.S.C. 154(b) by 126 days.

(21) Appl. No.: 11/254,576

(22) Filed: Oct. 20, 2005

(51) Int. Cl.
*A63B 21/062* (2006.01)
*A63B 21/00* (2006.01)

(52) U.S. Cl. ..... 482/100; 482/133

(58) Field of Classification Search ..... 482/91–100, 482/133, 135–137
See application file for complete search history.

(56) References Cited

U.S. PATENT DOCUMENTS

| | | | | |
|---|---|---|---|---|
| 2,131,570 | A * | 9/1938 | Riley | 482/72 |
| 4,390,179 | A * | 6/1983 | Szkalak | 482/100 |
| 4,949,951 | A * | 8/1990 | Deola | 482/138 |
| 5,643,152 | A * | 7/1997 | Simonson | 482/100 |
| 5,971,895 | A * | 10/1999 | Habing | 482/100 |
| 6,302,833 | B1 * | 10/2001 | Ellis et al. | 482/100 |
| 6,394,937 | B1 * | 5/2002 | Voris | 482/139 |
| 6,579,213 | B1 * | 6/2003 | Webber et al. | 482/100 |
| 6,689,023 | B2 * | 2/2004 | Baumler | 482/100 |
| 2003/0004043 | A1 | 1/2003 | Deola | |
| 2003/0195091 | A1 | 10/2003 | Webber et al. | |
| 2004/0005966 | A1 * | 1/2004 | Chen | 482/100 |
| 2004/0029688 | A1 * | 2/2004 | Webber et al. | 482/142 |
| 2004/0162194 | A1 | 8/2004 | Habing | |
| 2004/0162195 | A1 | 8/2004 | Habing | |
| 2004/0259700 | A1 | 12/2004 | Stewart et al. | |
| 2005/0239615 | A1 | 10/2005 | Keiser | |
| 2006/0035764 | A1 * | 2/2006 | Webber | 482/94 |

* cited by examiner

*Primary Examiner*—Loan H Thanh
*Assistant Examiner*—Allana Lewin
(74) *Attorney, Agent, or Firm*—Coats & Bennett, P.L.L.C.

(57) ABSTRACT

An exercise machine comprises a frame, a pair of arms pivotally mounted to the frame so as to be rotatable about a first axis to perform exercise, a resistance element connected to the arms to provide resistance for performing exercise and a path adjustment mechanism to independently adjust the travel path of the arms. The path adjustment mechanism may comprise a pair of mounting brackets for pivotally connecting respective arms to the frame. Each mounting bracket rotates about a second axis to change the travel path of the corresponding arm.

17 Claims, 19 Drawing Sheets

EXERCISE MACHINE WITH INDEPENDENTLY ADJUSTABLE ARMS

BACKGROUND

Various types of exercise machines for strengthening and conditioning the body are known. One type of exercise machine, referred to herein as a weight machine, exercises the user's muscles by having the user push, pull, or otherwise move an exercise assembly that is connected to a resistance device, such as a stack of weights. The exercise machine may include one or more exercise assemblies, each designed to exercise a specific muscle group. Some exercise assemblies may be configured by the user to perform two or more different exercises.

Common weight-lifting exercises include press and pull exercises. In press and pull exercises, the user pushes or pulls a pair of arms connected to a weight stack or other resistance device. The arms typically move along a fixed path that may converge or diverge during the exercise. There are a number of drawbacks with conventional press and pull exercise machines. In most prior press and pull exercise machines, the travel path of the arms is fixed. There are a number of reasons why a person may want to change the travel path of the arms. First, the user may want to adjust the arms to follow a path that is comfortable for the user. Second, the user may want to adjust the path of the arms to perform different exercises. Thus, there is a need for a press/pull-type exercise machine that enables the user to adjust the travel path of the arms.

Another drawback with conventional press and pull exercise machines is that press and pull exercises are typically performed at different machines or at different stations on a multi-station exercise machine. Having multiple machines or stations to perform both press and pull exercises increases the cost of the exercise equipment, as well as the space needed to house the exercise equipment. Thus, it would be desirable to perform both press and pull exercises at a single station on the same exercise machine.

SUMMARY

The present invention provides a press/pull exercise machine with means to independently adjust the travel path of the arms. The press/pull exercise machine comprises a frame, a pair of arms pivotally connected to the frame for rotation about a first axis to perform exercise, and a resistance device operatively connected to the arms to provide resistance. In one embodiment, the resistance element comprises a stack of weights connected to the arms by a cable assembly.

The arms are mounted to the frame in a manner that allows the user to independently adjust the travel path of each arm. In one exemplary embodiment, each arm is mounted to a swivel assembly that allows the arm to rotate about a second axis to adjust the travel path of the arms. Rotation of the arms about the second axis changes the travel path of the arms. The swivel assembly may include a locking mechanism to lock the arms in a fixed position during exercise. The user can adjust the travel path of the arms by unlocking the swivel assembly, rotating the arms about the second axis to a desired position, and relocking the swivel assembly in the new position.

In another aspect of the invention, a cable assembly connects the adjustable arms to a stack of weights. To accommodate changes in the travel path of the arms, the cable assembly includes one or more pulleys pivotally-connected to the frame and/or arms so as to self-align when adjustments are made to the travel path of the arms.

In another aspect of the invention, the arms include first and second sections that are pivotally connected together. The user can adjust the angle between the first and second sections.

DETAILED DESCRIPTION

Figure 1:
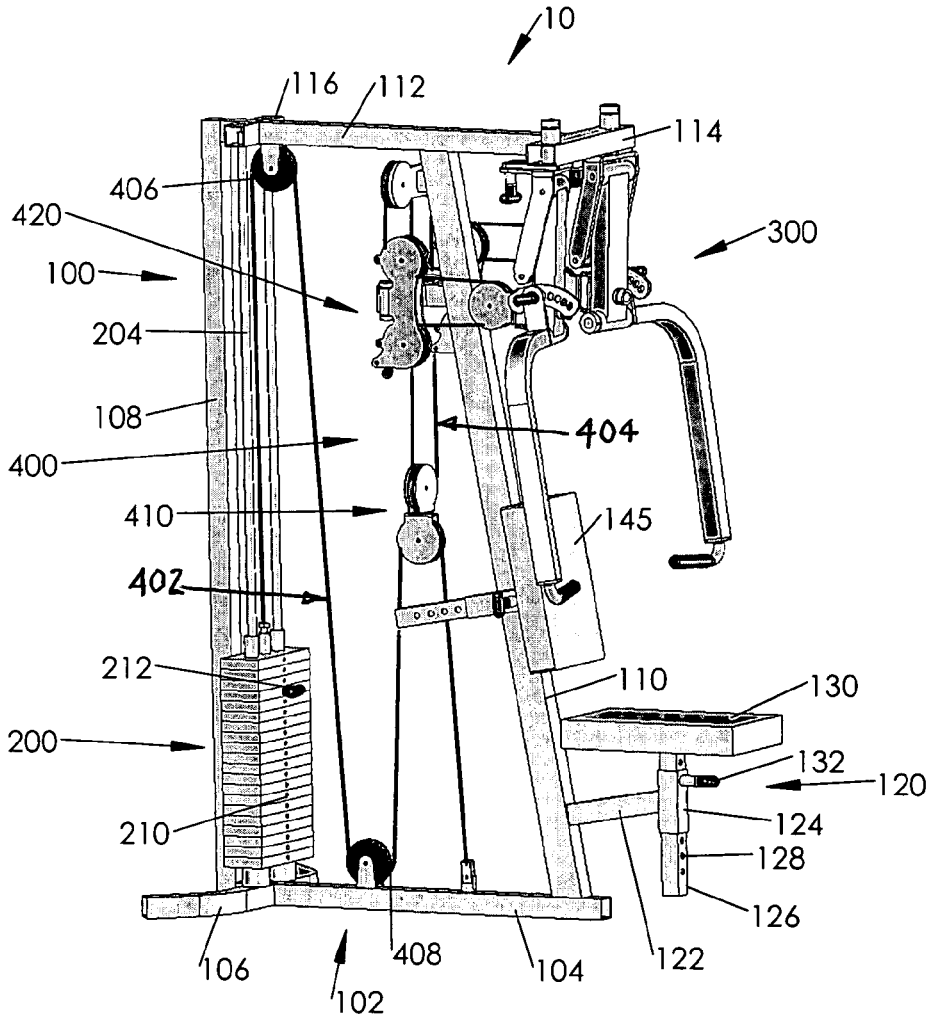
FIG. 1 is a perspective view illustrating an exemplary press/pull exercise machine according to the present invention from the front.
Figure 1:
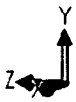

Referring now to the drawings, an exercise machine according to the present invention is shown therein and indicated generally by the numeral 10. The exercise machine 10 comprises a frame 100, weight stack 200 or other resistance element, exercise assembly 300, and cable system 400 interconnecting the exercise assembly 300 with the weight stack 200. The exemplary embodiment shown in the drawings is for performing press and pull exercises, such as chest presses, bench presses, shoulder presses, inclined presses, and mid row exercises. The exemplary embodiment may also be used to perform other exercises where two opposing arms are pushed, pulled or otherwise moved by the user.

The frame 100 provides structural support and stability to the exercise machine 10. The frame 100 includes a base 102 comprising frame members 104 and 106. Vertical frame members 108 and 110 extend upwardly from the base 102 to a top member 112. In the exemplary embodiment, the top member 112 extends generally from front to back. Vertical member 108 is disposed toward the back of the exercise machine 10. Vertical member 110 is disposed toward the front of the exercise machine 10. Frame 100 further includes an upper cross member 114 at the forward end of the top member 112. The upper cross member 114 extends generally perpendicularly to the top member 112. Cross member 114 provides an attachment point for the exercise assembly 300 as will be hereinafter described below. A pair of guide rod supports 116 are mounted on opposing sides of the top member 112 adjacent the rear end thereof. The guide rod supports 116 secure the ends of the guide rods 204 which guide the weight stack 200. A tee-shaped support member 118 extends rearward from the vertical member 110 and provides support for a pair of guide pulley assemblies 420.

The frame 100 further includes a seat support 120 and back support 140. The seat support 120 includes a support member 122 extending from the front vertical member 110. A support sleeve 124 is connected at the forward end of the support member 122. The support sleeve 124 receives a seat post 126 extending from the bottom of a seat 130. The seat 130 may include a cushioned pad. The seat post 126 includes a series of openings 128 that are engaged by a locking pin 132. The locking pin 132 is preferably biased to a locked position. The seat height can be adjusted by disengaging the locking pin 132, adjusting the seat 130 to the desired height, and reengaging the locking pin 132 in one of the apertures 128 in the seat post 126.

The back support 140 comprises a support sleeve 142 secured to the side of the vertical member 110. The support sleeve 142 receives a back post 144 extending from a seat back 145. The seat back 145 may have a cushioned pad. The back post 144 includes a series of apertures 146 that are engaged by a locking pin 148. The seat back 145 can be adjusted in a manner similar to the seat 130 by disengaging the locking pin 148, adjusting the seat back 145 to the desired position, and reengaging the locking pin 148 with one of the apertures 146 in the back post 144. Preferably, the seat back 145 is angled slightly as illustrated in FIG. 1.

Figure 2:
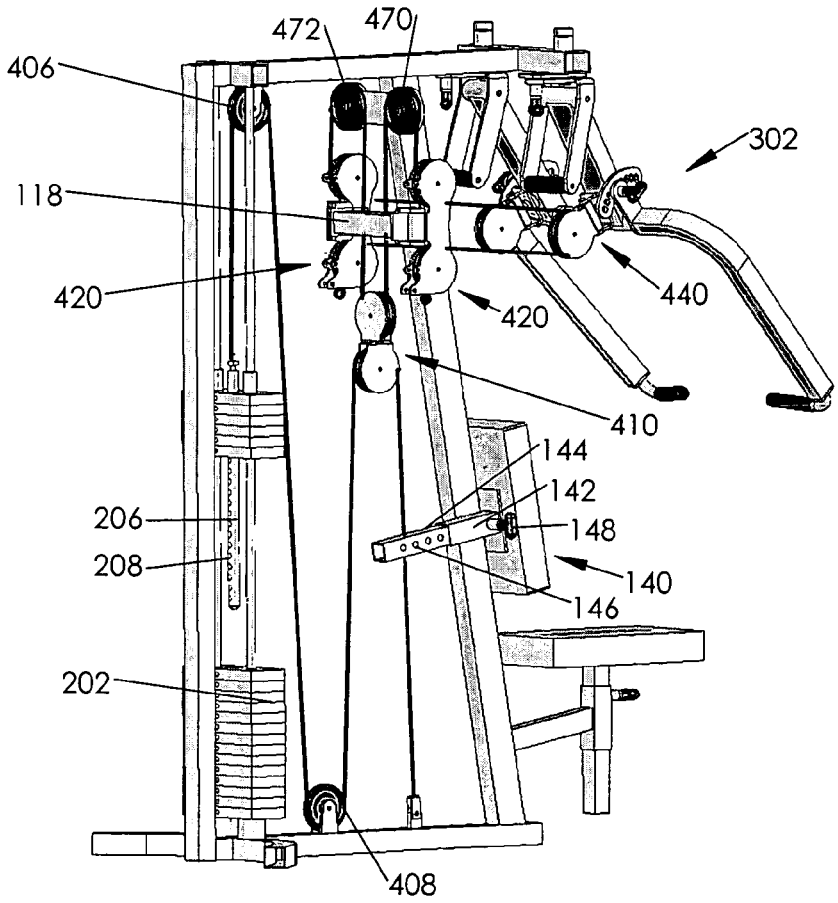
FIG. 2 is a perspective view illustrating an exemplary press/pull exercise machine according to the present invention from the back.
Figure 2:
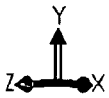

The weight stack 200 provides resistance to the force applied by the user to the exercise assembly 300. In the exemplary embodiment, the weight stack 200 includes a number of individual weight plates 202 that can be selectively added to and removed from the load picked-up by the user to provide variable amounts of resistance. Guide rods 204 extend through apertures in each of the plates 202. The bottom end of the guide rods 204 are secured to the base 102. The top end of the guide rods 204 are secured to respective guide post supports 116. The plates 202 slide vertically along the guide rods 204 as the user exercises. A lifting rod 206 extends through a central opening in the weight plates 202. The lifting rod 206, shown best in FIG. 2, includes a series of apertures 208 that align with corresponding apertures 210 in the weight plates 202. The user selects the desired number of plates 202 to be lifted by inserting a pin 212 through the aperture 210 in a selected plate 202 and engaging the pin 212 with the aperture 208 in the lifting rod 206. Those skilled in the art will appreciate that other resistance devices, such as electronic resistance devices or magnetic breaks, may also be used to practice the present invention.

The exercise assembly 300 comprises a pair of arms 302 that are pushed or pulled by the user to perform exercises. The arms 302 are interconnected with the weight stack 200 by the cable assembly 400. Each arm 302 is pivotally connected to the frame 100 so as to pivot about first and second axes labeled X1 and X2, respectively. The arms 302 rotate about axis X1 when the user is exercising. The arms 302 rotate about axis X2 to change the travel path of the arms 302, as will be hereinafter described in further detail. Normally, the adjustment of the travel path is done prior to exercising and the travel path is fixed while exercising. For each arm 302, the user may select a neutral path, a converging path, or a diverging path. Different paths can be selected for different arms 302. For example, the right arm may be set to follow a diverging path, while the left arm is set to follow a converging path. Thus, the travel paths for the arms 302 are independently selectable.

Figure 10:
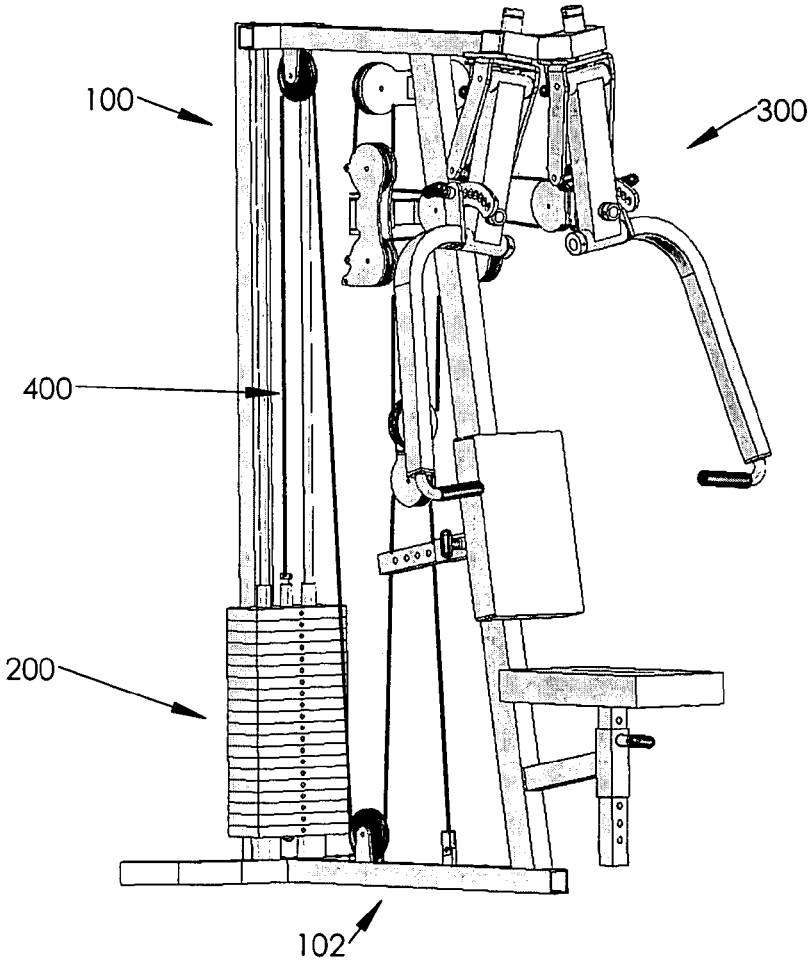
FIG. 10 is a perspective view of an alternate embodiment of the exercise machine.
Figure 10:
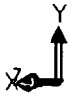
Figure 24:
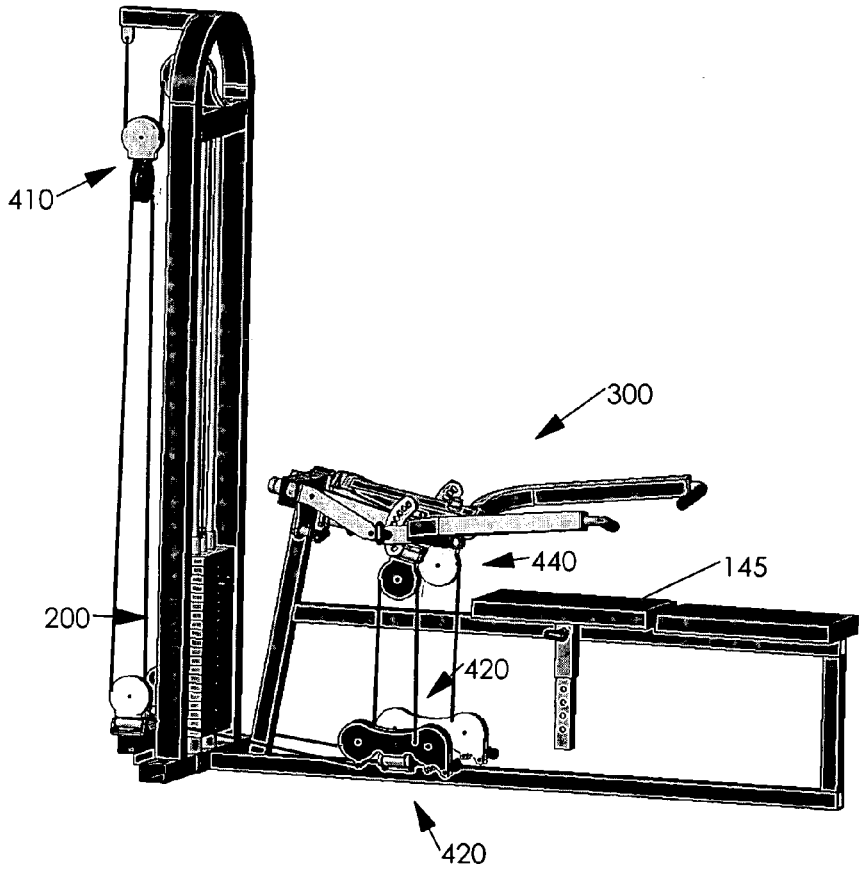
FIG. 24 illustrates a third embodiment of the exercise machine for performing press/pull exercises in a prone position.
Figure 24:
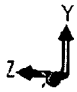

In the exemplary embodiment, the first axis X1 for both arms 302 are disposed in a horizontal plane, and the second axis X2 for both arms 302 are parallel and disposed in a vertical plane. Those skilled in the art will appreciate that the orientation of the axes is not limited to horizontal and vertical planes. Nor is it necessary that the axes X1 for the respective arms to be collinear, or for the axes X2 to be parallel. For example, FIG. 10 illustrates an alternate embodiment of the exercise machine where the axes X1 and X2 for each arm 302 lie in tilted planes. FIG. 24 illustrates a third embodiment wherein the axes X1 and X2 are oriented to perform press/pull exercises in a prone position.

Figure 3:
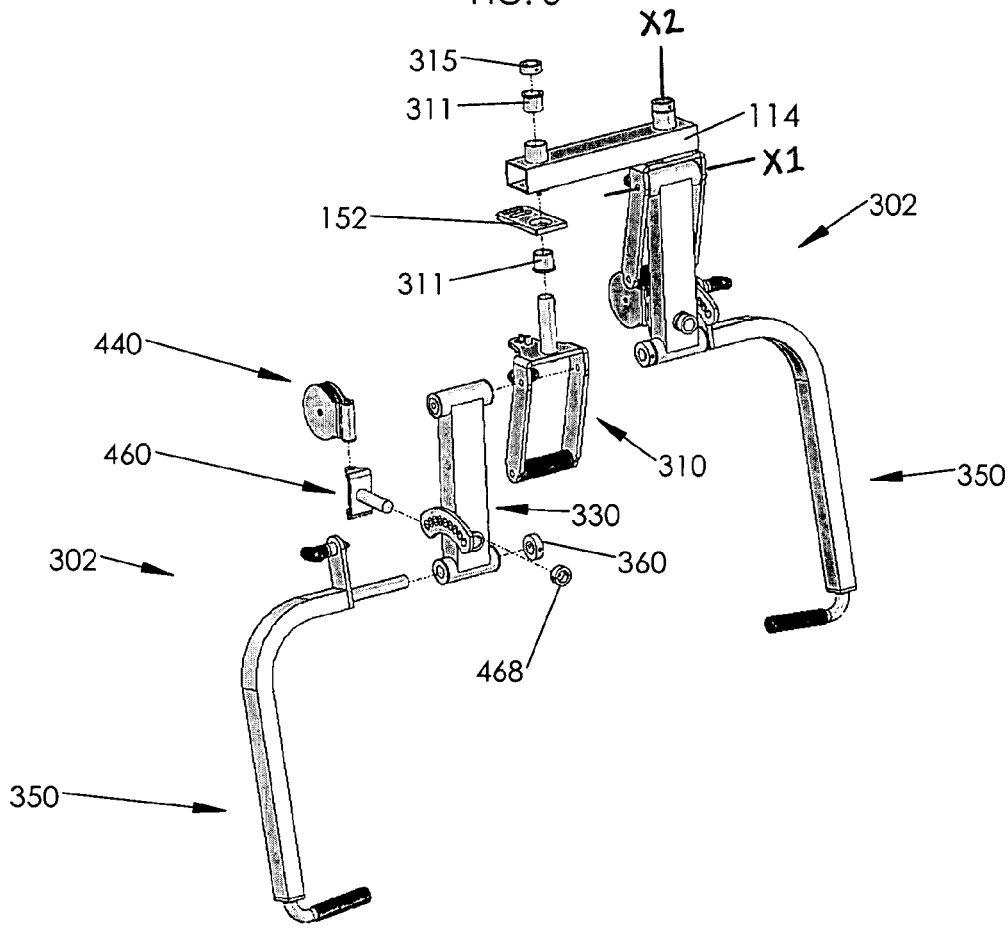
FIG. 3 is an exploded perspective view illustrating an exemplary exercise assembly for the exercise machine from the front.
Figure 3:
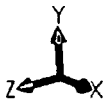
Figure 4:
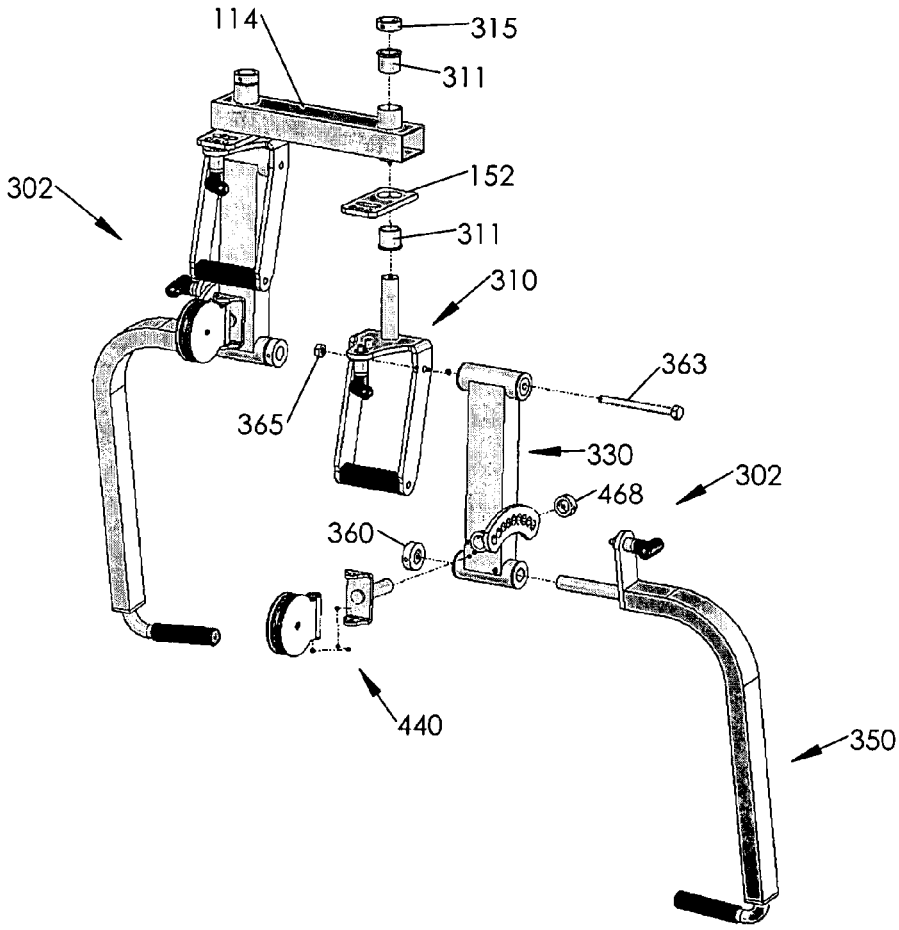
FIG. 4 is an exploded perspective view illustrating an exemplary exercise assembly for the exercise machine from the back.
Figure 4:
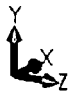
Figure 5:
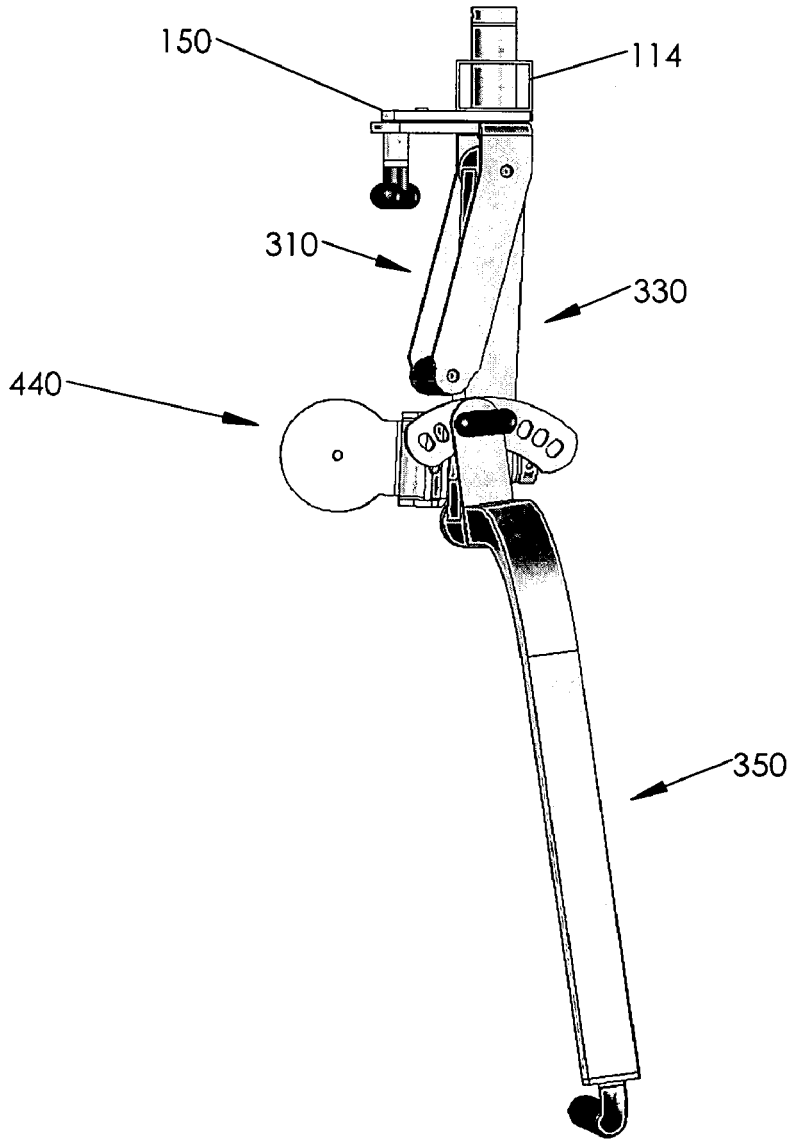
FIG. 5 is a side elevation view of the exemplary exercise assembly.
Figure 5:
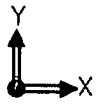

FIGS. 3-5 illustrate exemplary details of the exercise assembly 300. FIGS. 3 and 4 are exploded perspective views illustrating the main components of one arm 302, it being understood that the construction of the other arm 302 is the same. FIG. 5 is a side elevation view of the exercise assembly 300. The arm 302 comprises three main components: a swivel assembly 310, upper arm 330, and lower arm 350.

Figure 6:
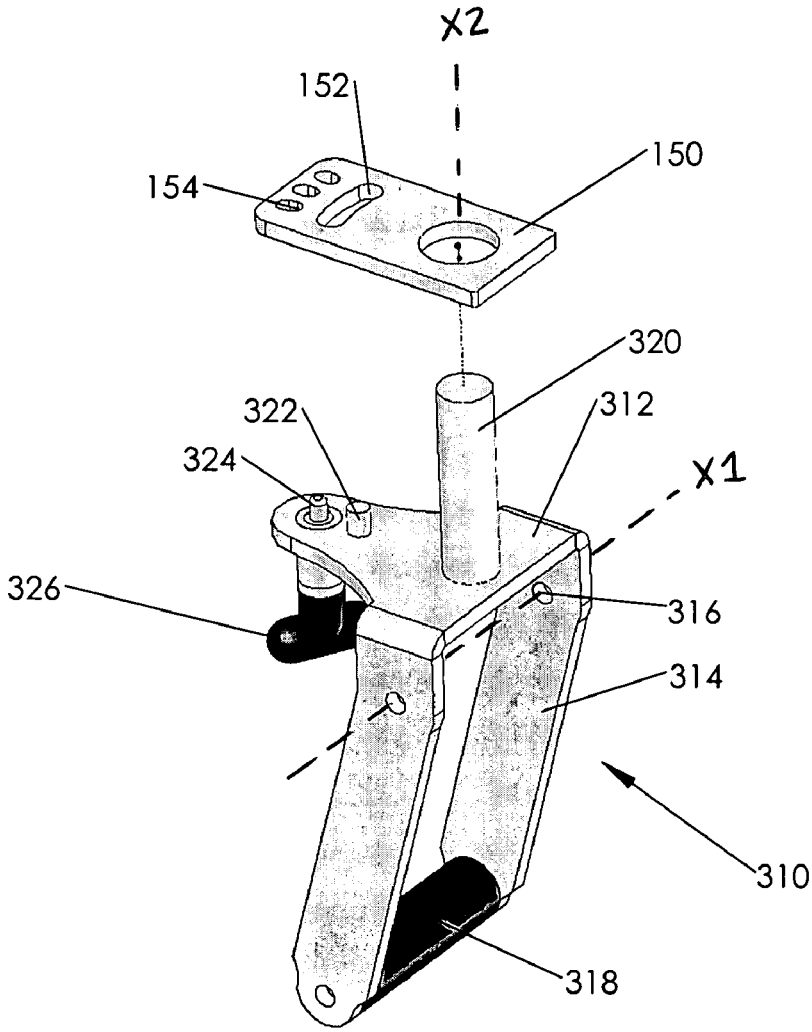
FIGS. 6-8 are perspective views illustrating components of the exercise assembly.
Figure 6:
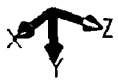

Swivel assembly 310, shown in FIG. 6, comprises a generally U-shaped mounting bracket including a top plate 312 and opposing side plates 314. A bumper 318 extends between the side plates 314 at the lower end of the swivel assembly 310. The bumper 318 serves as a stop or rest for the upper arm 330. The side plates 314 include mounting holes 316 which are used to pivotally connect the upper arm 330 to the swivel assembly 310. The mounting holes 316 lie along the first axis X1. A shaft 320 extends upward from the top plate 312 along the second axis X2. The shaft 320 is journaled in a pair of bushings 311 and extends upwardly through aligned openings in the cross member 114 and a locking plate 150 to rotatably connect the swivel assembly 310 to the frame 100. The shaft 320 is secured by a collar 315 so that the entire swivel assembly 310 pivots about the second axis X2.

Locking plate 150 is fixedly connected to the cross member 114 of the frame 100. Limit pin 322 extends upward from the top plate 312 of the swivel assembly 310 and is received in a slot 152 in the locking plate 150. The engagement of the limit pin 322 in the slot 152 limits the angular rotation of the swivel assembly 310 as it rotates about the second axis X2. Locking pin 324 projects upwardly from the top plate 312 and engages one of a series of locking holes 154 in the locking plate 150.

Locking pin 324 is connected to a handle 326. The user can disengage the locking pin 324 from the locking hole 154 by pulling downward on the handle 326. The locking pin 324 is preferably biased to a locked position as shown in FIG. 5. When the handle is released, the locking pin 324 re-engages with a selected locking hole 154 in the locking plate 150. As will be explained below, rotation of the swivel assembly 310 about axis X2 changes the path of travel of the arm 302.

Figure 7:
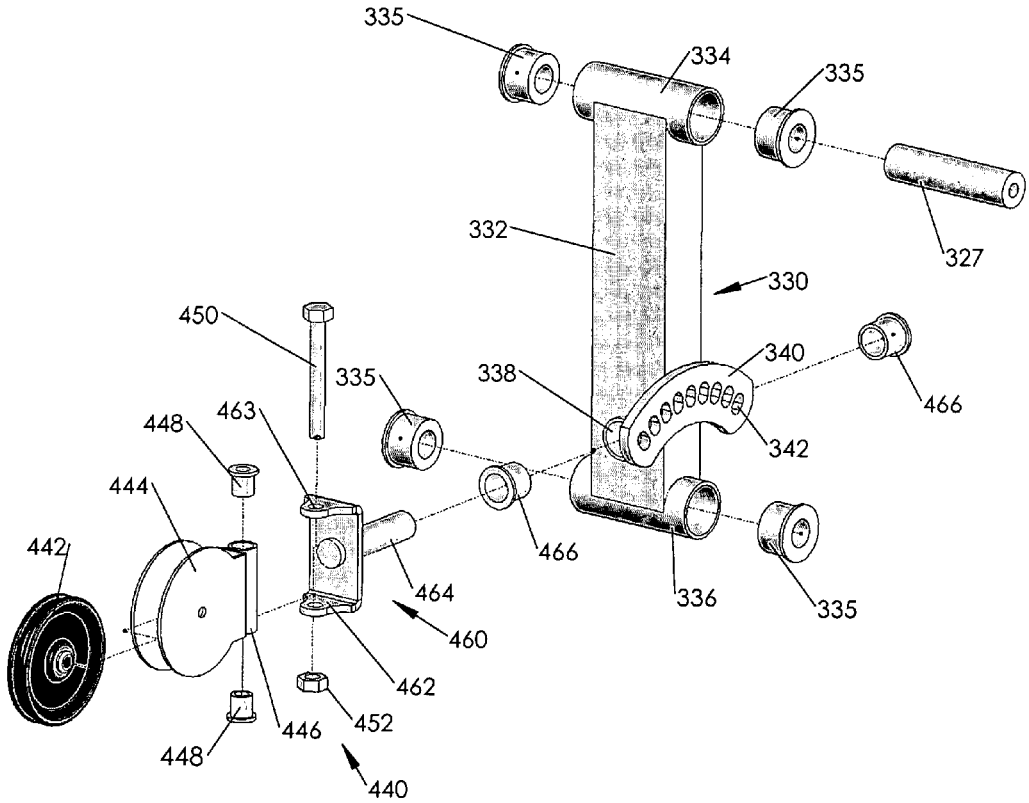
Figure 7:
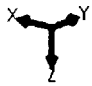

The upper arm 330 is shown in FIG. 7. The upper arm 330 comprises an arm member 332 having sleeves 334 and 336 attached at opposite ends thereof. Bushings 335 fit into the ends of the sleeves 334 and 336. A spacer 327 is journaled in the bushings 335 and serves as a pivot member for the bushings 335 in sleeve 334. Sleeve 334 fits between the side plates 314 of the swivel assembly 310 and aligns with the mounting holes 316. Bolt 363 passes through the mounting holes 316 in the side plates 314 and through spacer 327 to pivotally connect the upper arm 330 to the swivel assembly 310. Nut 365 threads onto the end of the bolt 363 to secure the bolt 363. Mounting sleeve 336 is used to pivotally connect the lower arm 350 to the upper arm 330 as will be described below. An opening 338 is formed in the arm member 332 for mounting movable pulley assemblies 440 to the upper arms 330 as will be hereinafter described. An aperture plate 340 including a series of apertures 342 is secured to the side of the arm member 332. The aperture plate 340 is used to adjust the angle between the upper arm 330 and lower arm 350 as hereinafter described.

Figure 8:
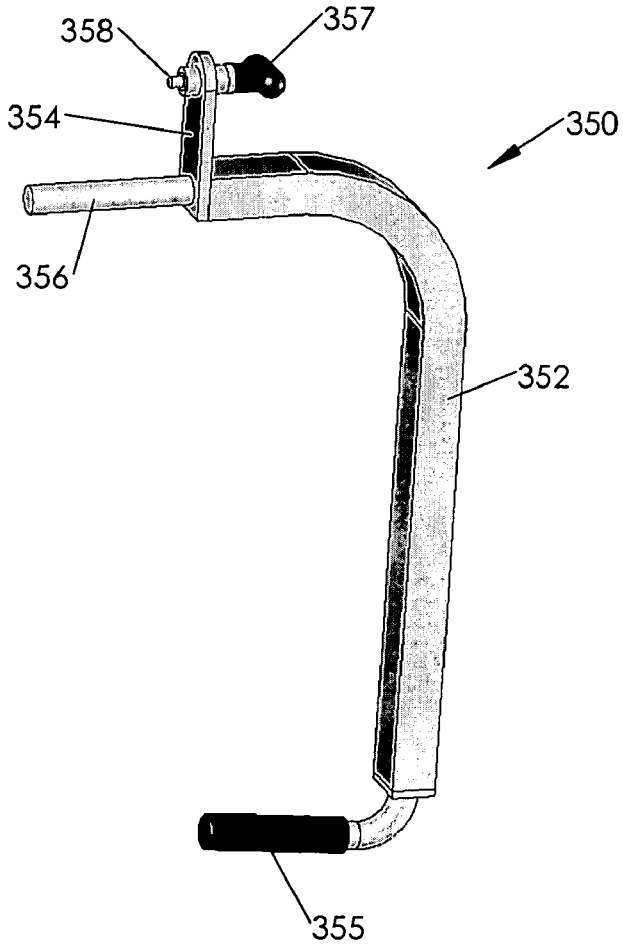
Figure 8:
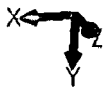

FIG. 8 illustrates the lower arm 350. The lower arm 350 includes an L-shaped member 352 having a pivot shaft 356 connected to the upper end thereof and a handle 355 connected to the lower end thereof. Pivot shaft 356 inserts into the mounting sleeve 336 of the upper arm 330 and is rotatably journaled in bushings 335 in the mounting sleeve 336 to rotatably connect the lower arm 350 to the upper arm 330. Pivot shaft 356 is secured by a collar 360 (FIG. 4) that mounts onto the end of the pivot shaft 356. An extension plate 354 extends upwardly from the lower arm 352 to mount a locking pin 358. The locking pin 358 engages a selected aperture 342 in the aperture plate 340 on the upper arm 330. The angle between the upper arm 330 and lower arm 350 is adjusted by engaging the locking pin 358 on the lower arm 350 with a selected aperture 342 on the aperture plate 340.

Figure 20:
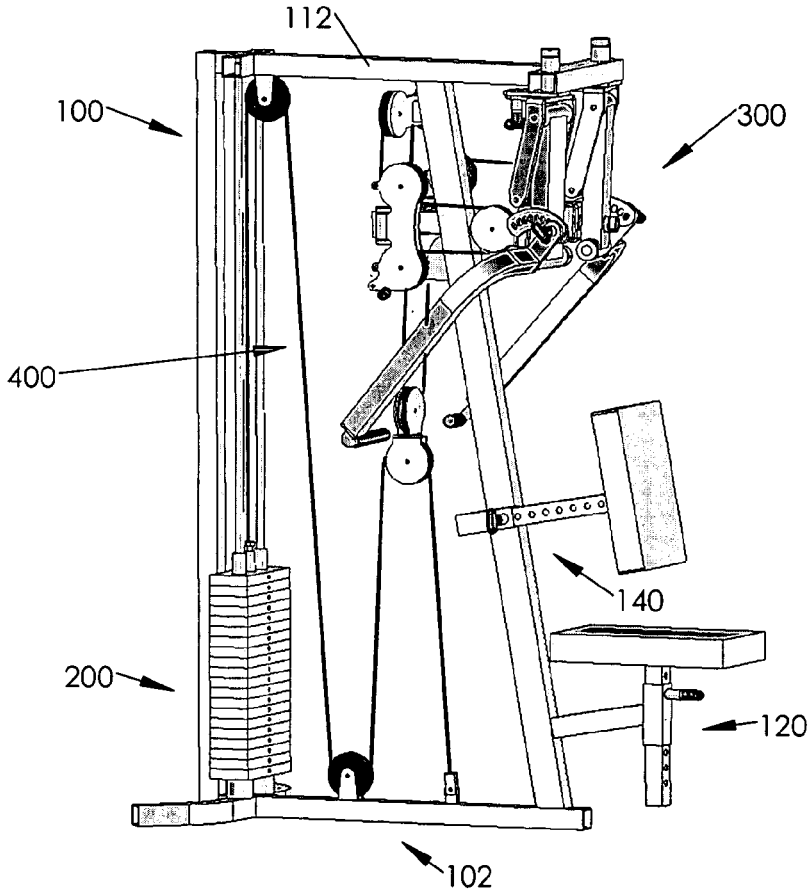
FIG. 20 is a perspective view illustrating the exercise assembly configured to perform mid row exercises.
Figure 20:
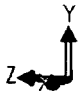
Figure 23:
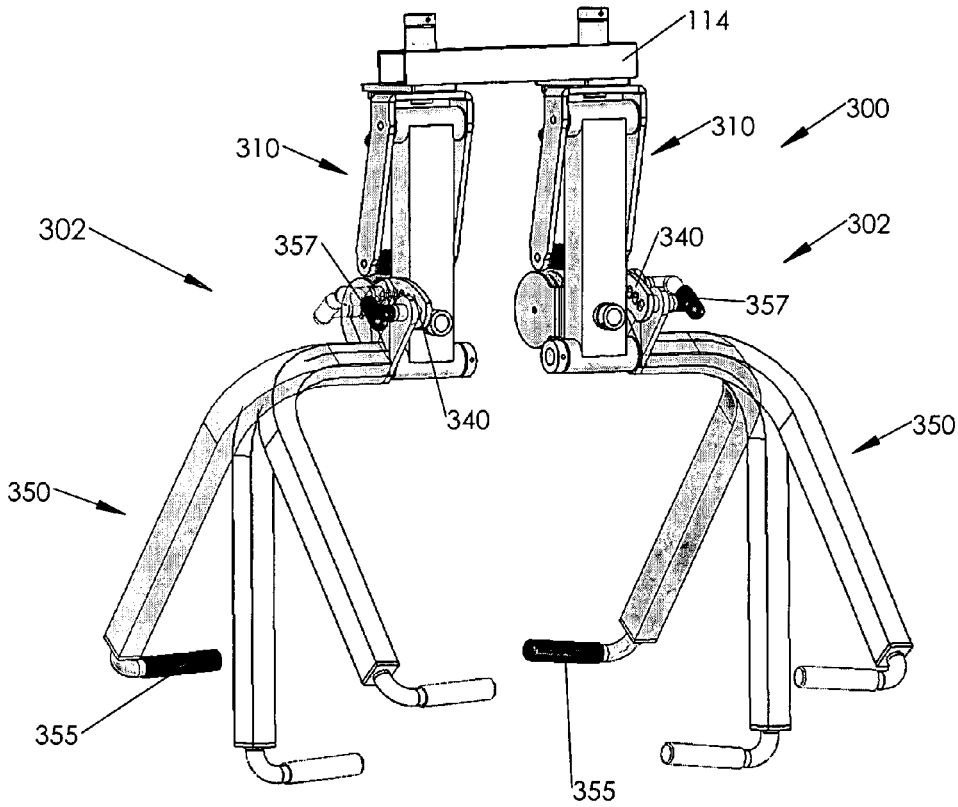
FIG. 23 is a perspective view of the exercise assembly illustrating the lower arms in various angular positions relative to the upper arms.
Figure 23:
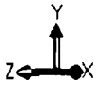

FIG. 23 illustrates how the angle between the upper and lower arms 330 and 350 is adjusted. To adjust the angle, the user pulls on a handle 357 of the locking pin 358 to disengage the locking pin 358 from the aperture plate 340, rotates the lower arm 350 to the desired angle, and releases the handle 357 to allow the locking pin 358 to reengage with the aperture plate 340. FIG. 1 illustrates the arms 302 angle forwardly in a configuration to perform press exercises. In this case, the user sits facing forward and pushes the arms outward to perform press exercises. For comparison, FIG. 20 illustrates the same exercise machine 100 with the arms 302 angled backwardly in a pull configuration to perform pull exercises. In this configuration, the user sits facing rearward and pulls the arms 302 forward.

The cable assembly 400 interconnects the arms 302 of the exercise assembly with the weight stack 200 so that when either one of the arms 302 are pushed or pulled outward by the user during exercise, the weight stack 200 is lifted. An exemplary cable assembly 400 is described below. Those skilled in the art will appreciate that a similar result could be achieved using a different configuration of pulleys and cables. Also, belts, chains, and rods with universal ends could be used instead of cables to connect exercise assembly 300 to the weight stack 200.

The exemplary cable assembly 400 includes first and second cables 402 and 404 respectively. The first cable 402 connects to the weight stack 200. The second cable 404 connects to the arms 302 of the exercise assembly 300. The cable assembly 400 further includes a double floating pulley assembly 410 interconnecting the cables 402 and 404, a pair of guide pulley assemblies 420 pivotally connected to the frame 100, a pair of movable pulley assemblies 440 mounted to respective arms 302, and fixed pulleys 406, 408, 470, and 472, which are fixedly secured to the frame 100.

Figure 9:
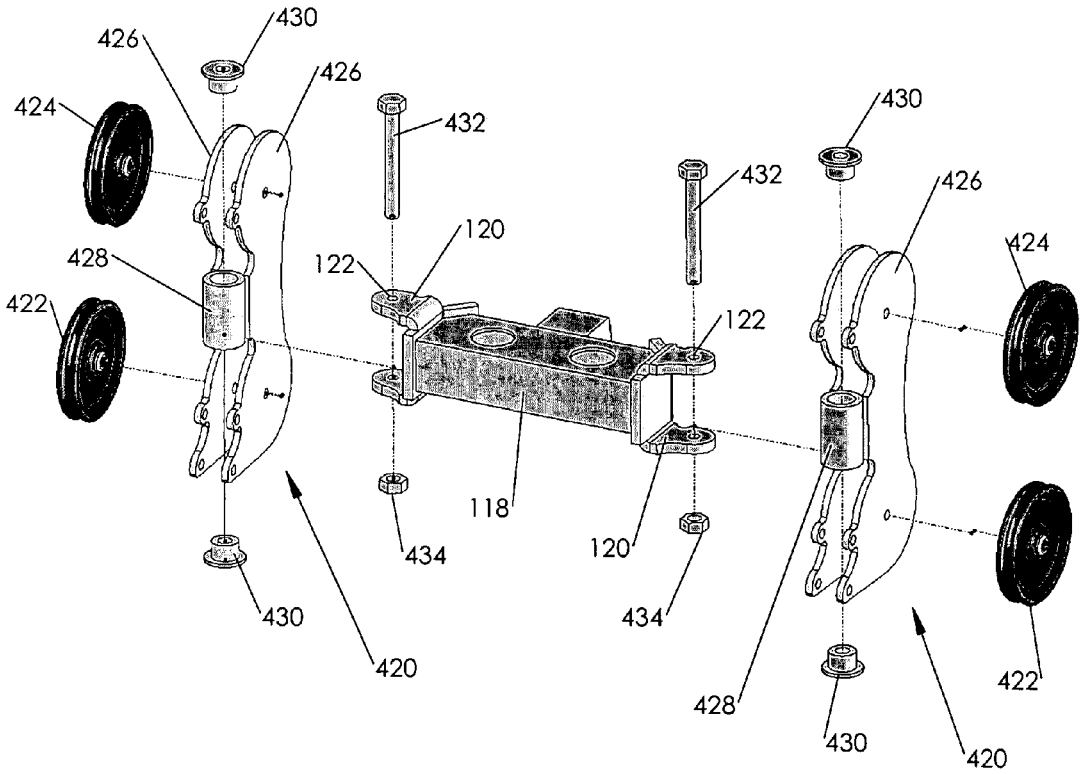
FIG. 9 is a perspective view illustrating a guide pulley assembly.
Figure 9:
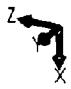

The guide pulley assemblies 420, shown in detail in FIG. 9, include pulleys 422 and 424 mounted between side plates 426, and mounting sleeve 428. Guide pulley assemblies 420 are pivotally connected to support member 118 on the frame 100. Bushings 430 fit into the open ends of the mounting sleeve 428. Bolt 432 and nut 434 secure the guide pulley assemblies 420 to a mounting bracket 120. Bolts 432 pass through mounting holes 122 in the mounting brackets 120 and through the bushings 430 in the mounting sleeve 428. The guide pulley assemblies 420 along with bushings 430 rotate on bolts 432 about a substantially vertical axis to maintain alignment with the cable 404 when the travel paths of the arms 302 are adjusted and during movement of the arms 302.

The movable pulley assemblies 440, shown in detail in FIG. 7, includes a pulley 442 rotatably mounted between a pair of side plates 444, and a mounting sleeve 446 joining the side plates 444. Bushings 448 fit into the open ends of the mounting sleeves 446. Bolts 450 and nuts 452 pivotally secure the movable pulley assemblies 440 to universal mounts 460. Universal mounts 460 includes a mounting bracket with mounting holes 463 formed therein and a mounting shaft 464 extending rearward from the mounting bracket 462. Bolts 450 pass through the mounting holes 463 in the mounting bracket 462 and through the bushings 448 in the mounting sleeve 446. The movable pulley assemblies 440 along with bushings 448 rotate on bolts 450 to maintain alignment with the cable 404 when the travel paths of the arms 302 are adjusted and during movement of the arms 302. The mounting shafts 464 of the universal mounts 460 pass through the openings 338 in respective upper arms 330 and are rotatably journaled in bushings 466. The universal mounts 460 are secured to respective upper arms by collars 468 that secure to the end of the mounting shafts 464. The universal mounts 360 rotate about the axis of the mounting shafts 464. From the forgoing, it will be apparent to those skilled in the art that the universal mount 460 allows rotation of the movable pulley assemblies 440 about two axes of rotation.

Cable 402 is connected at one end to the lift rod 206 and at the opposite end to the base 102. Cable 402 passes around fixed pulleys 406 and 408 and floating pulley 412 in the floating pulley assembly 410. While the cable 402 is depicted as being anchored to the base 102, those skilled in the art will appreciate that the cable 402 could also be connected to another exercise assembly. Cable 404 passes around floating pulley 414 of the floating pulley assembly 410, fixed pulleys 470 and 472, pulleys 424 of the guide pulley assemblies 420, pulleys 442 of the movable pulley assemblies 440, and pulleys 422 of guide pulley assemblies 420. A ball stop 416 is attached to each ends of cable 404 to secure the ends cable 404 to the guide pulley assemblies 420. Those skilled in the art will appreciate that the ends of the cable 404 could also be connected to other exercise assemblies.

In use, the user adjusts the angle of the lower arm 350 to a comfortable position depending on factors such as the user's arm length, flexibility and the exercise chosen. The user also adjusts the travel path for each arm 302 by rotating each arm 302 about the second axis X2 to a desired position. As noted earlier, the travel path of each arm can be independently selected. For each arm 302, the user can select a neutral path, (center position), converging path (outer position) or diverging path (inner position). The exemplary embodiment has only one converging and one diverging path. Those skilled in the art will appreciate that some embodiments may provide for multiple converging and diverging paths. After the adjustments are made, the user sits on seat 130 with the user's back or chest against the seat back 145. The user grasps the handles 355 for each arm 302 and pushes or pulls the arms 302 outward to lift the weight stack 200. During exercise, the arms 302 rotate about the first axis X1. Each arm will follow either a neutral path, converging path, or diverging path as selected by the user. The guide pulley assemblies 420 and the movable pulley assemblies 440 on the arms 302 will rotate to self-align with the cable 404 when the travel path of the arms 302 is adjusted and during movement of the arms 302. The user may choose to use the arms independently one at a time for some exercises.

Figure 11:
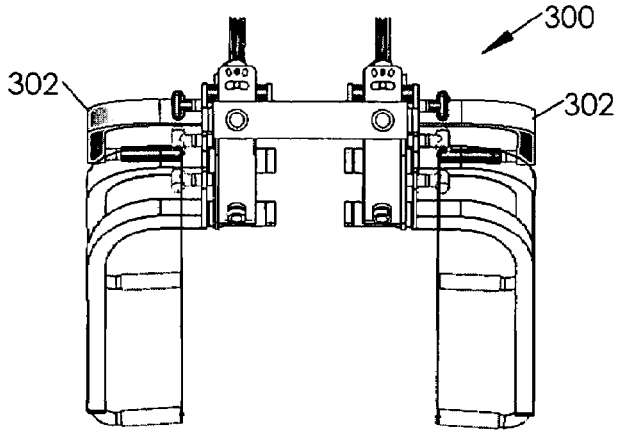
FIG. 11 is a top view of the exercise assembly with the arms configured to follow a neutral path.
Figure 11:
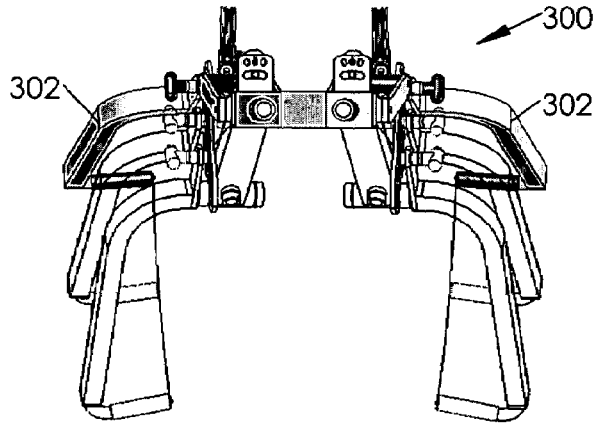
Figure 12:
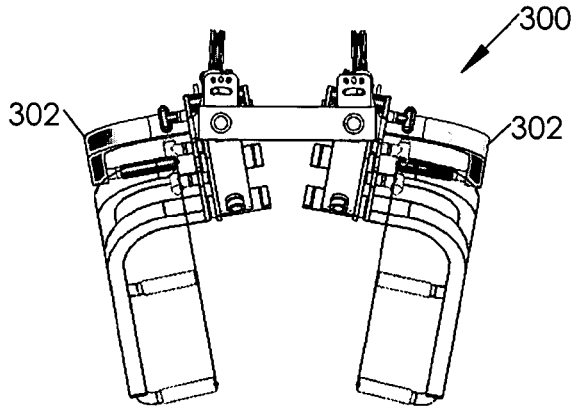
FIG. 12 is a top view of the exercise assembly with the arms configured to follow converging paths relative to a medial plane.
Figure 12:
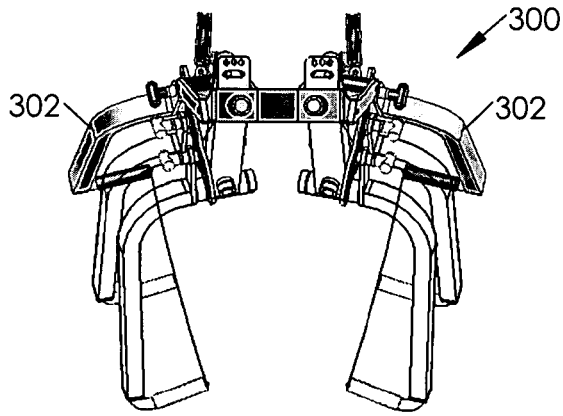
Figure 13:
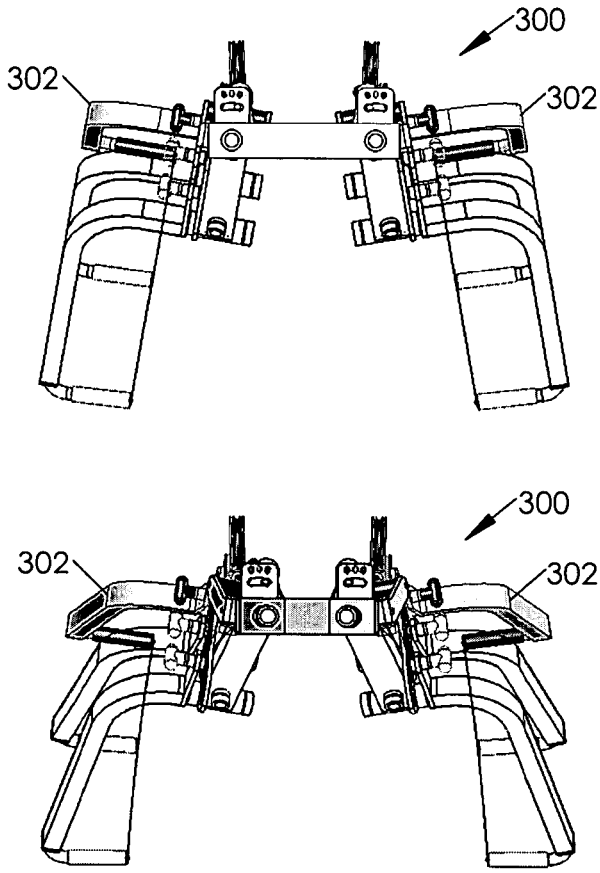
FIG. 13 is a top view of the exercise assembly with the arms configured to follow diverging paths relative to a medial plane.
Figure 14:
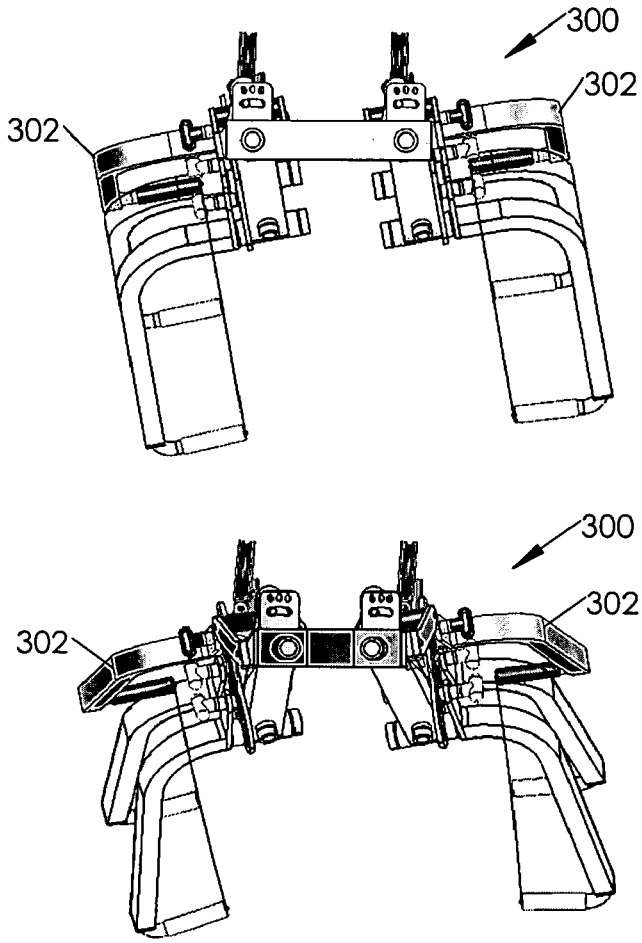
FIG. 14 is a top view of the exercise assembly with one arm configured to follow a converging path and the other arm configured to follow a diverging path.

FIGS. 11-14 are top views of the exercise assembly 300 illustrating the various travel paths of the arms 302. FIGS. 11-14 illustrate the exercise machine shown in FIG. 1 wherein axes X1 and X2 are orthogonal. FIG. 11 illustrates a neutral path. In this configuration, the arms 302 move parallel to the medial plane when the user pushes outwardly. FIG. 12 illustrates a converging path. In this configuration, the arms 302 move toward a medial plane of the exercise machine 10 when the user pushes the arms 302 outward. FIG. 13 illustrates the diverging path. In this configuration, the arms 302 move away from the medial plane as the user pushes outwardly. The travel paths for the arms 302 can be set independently. Thus, one arm can be set to follow a diverging path, while the other arm is set to follow a converging path or neutral path as shown in FIG. 14. The ability to independently adjust the travel paths for each arm 302 provides a greater variety of exercise.

Figure 15:
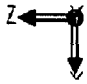
FIG. 15 is a top view of an alternate exercise assembly with the arms configured to follow a neutral path.
Figure 16:
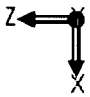
FIG. 16 is a top view of an alternate exercise assembly with the arms configured to follow converging paths relative to a medial plane.
Figure 17:
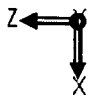
FIG. 17 is a top view of an alternate exercise assembly with the arms configured to follow diverging paths relative to a medial plane.
Figure 18:
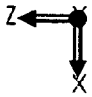
FIG. 18 is a top view of an alternate exercise assembly with one arm configured to follow a converging path and the other arm configured to follow a diverging path.
Figure 19:
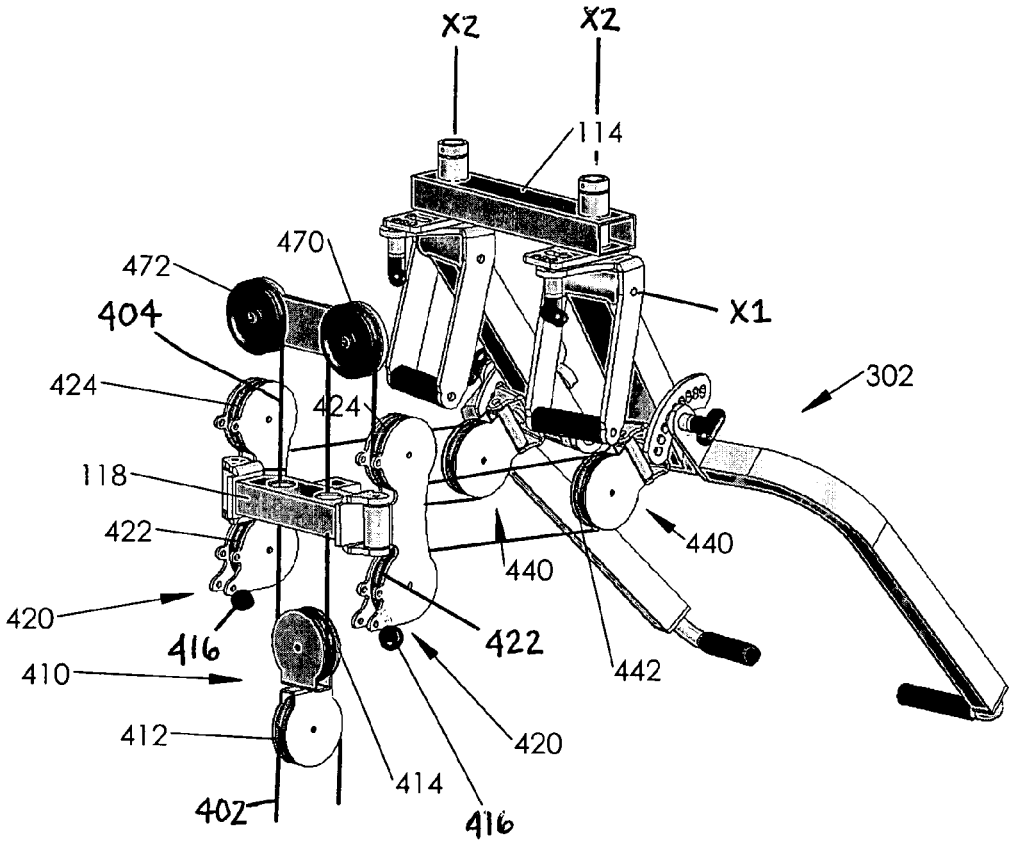
FIG. 19 is a perspective view showing a portion of the cable assembly.
Figure 19:
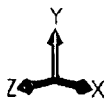

For comparison, the FIGS. 15-18 illustrate the exercise machine 10 shown in FIG. 10 wherein the axes X1 and X2 are tilted. FIGS. 15-18 show the exercise assembly in the same configurations as FIGS. 11-14 respectively. FIG. 15 corresponds to the neutral path configuration in FIG. 11. FIG. 16 corresponds to the converging path configuration in FIG. 12. FIG. 17 corresponds to the diverging path configuration in FIG. 13. FIG. 18 corresponds to the converging/diverging path configuration in FIG. 14. Because the arms 302 rotate in a tilted plane in this embodiment, the travel paths of the arms 302 are slightly curved when viewed from above. Also, in the neutral setting, the arms 302 will converge slightly. In the exemplary embodiment, the degree of tilt of the axis X2 is fixed. The amount of tilt could be made to be adjustable by the user to allow adjustment in the range of approximately 0 to 20 degrees from vertical. Adjusting the amount of tilt would provide another means to change the travel paths of the arms.

Figure 21:
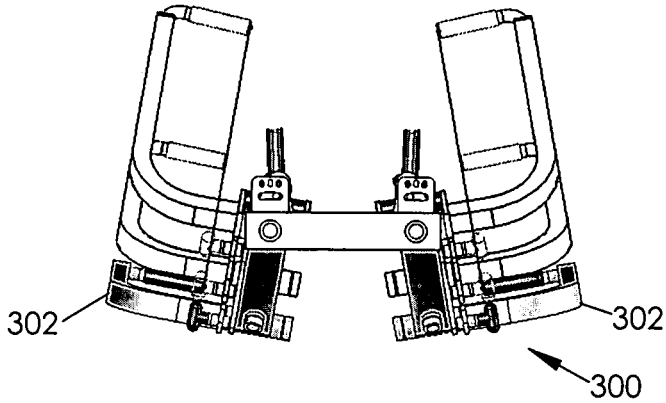
FIG. 21 is a top view of the exercise assembly configured to perform pull exercises.
Figure 21:
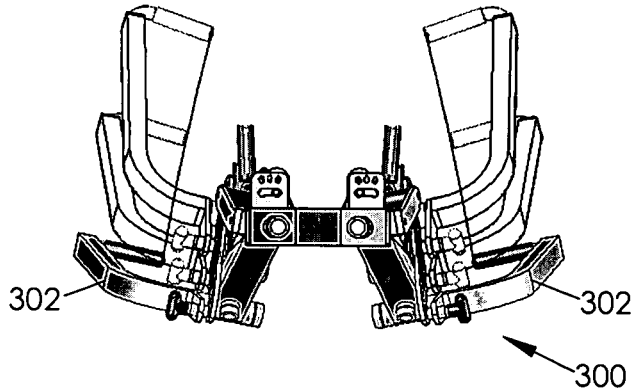
Figure 22:
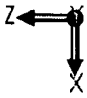
FIG. 22 is a top view of an alternate exercise assembly configured to perform mid row exercises.

FIG. 20 illustrates the exercise machine 10 with the lower arms 350 angled backward to perform pull exercises. In this configuration, the user sits facing backward and pulls the arms 302 forward to perform exercise. FIG. 21 shows the travel path of the arms in a diverging configuration. For comparison, FIG. 22 shows the travel path of the arms 302 for the exercise machine shown in FIG. 10.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise machine comprising:

a frame;

a pair of arms, each arm rotatable about a respective first axis to perform exercise;

a pair of swivel assemblies for mounting respective arms to said frame, each swivel assembly being rotatable about a respective second axis to change the orientation of said first axis for a respective arm and to adjust the travel path of the respective arm;

a locking mechanism to lock each said swivel assembly in a fixed position during exercise to maintain the orientation of the first axis for each respective arm in a fixed position; and at least one resistance element connected to said arms to provide resistance for performing exercise and to resist rotation of said arms about respective first axes.

2. The exercise machine of claim 1 wherein each said swivel assembly comprises a mounting bracket rotatably connected to the frame, and wherein a respective arm is pivotally connected to the mounting bracket.

3. The exercise machine of claim 2 wherein said mounting bracket includes a bumper to engage and support a respective arm when said arm is in a rest position.

4. The exercise machine of claim 1 further including a cable assembly connecting said arms to said resistance device.

5. The exercise machine of claim 4 wherein said cable assembly includes a movable pulley rotatably mounted to each arm, each said movable pulley including a pulley mount for mounting said pulley to said arm, wherein each said pulley mount is pivotally attached to a respective said arm.

6. The exercise machine of claim 5 further including a pair of guide pulleys pivotally connected to said frame, and a cable passing around said movable pulleys on said arms and said guide pulleys on said frame, wherein said movable pulleys and said guide pulleys rotate to align when said arms are moved.

7. The exercise machine of claim 1 wherein said resistance element comprises a weight stack.

8. The exercise machine of claim 1 wherein said arms comprise upper and lower arm sections pivotally connected together, and an angular adjustment mechanism to adjust the angle between said upper and lower arm sections.

9. The exercise machine of claim 8 wherein said angular adjustment mechanism comprises an aperture plate mounted to one of said upper arm section and said lower arm section and having a plurality of apertures formed therein, and a locking pin mounted to the other of said upper arm section and said lower arm section for engagement with a selected aperture of said aperture plate.

10. The exercise machine of claim 1 wherein said locking mechanism comprises a locking plate mounted to one of said frame and said swivel assembly and having a plurality of apertures, and a locking pin mounted to the other of said frame and said swivel assembly to engage a selected aperture of said locking plate to lock said arm in a desired position.

11. The exercise machine of claim 10 further including a means to limit rotation of said arms about said second axis.

12. The exercise machine of claim 11 wherein said means for limiting rotation of said arms about said second axis comprises a pin on said swivel assembly engaged in a slot in said locking plate.

13. An exercise machine comprising:

a frame;

a pair of movable arms rotatably mounted to the frame for rotation about a first axis to perform exercises, each arm including an upper arm section and a lower arm section pivotally connected to the upper arm section;

an angular adjustment mechanism for each movable arm to adjust the angle between the upper and lower arm sections independently of the other arm, said angular adjustment mechanism comprising an aperture plate mounted to one of said upper arm section and lower arm section and having a plurality of apertures formed therein, and a locking pin mounted to the other of said upper arm section and said lower arm section for engagement with a selected aperture of said aperture plate; and at least one resistance element connected to said arms to provide resistance for performing exercise.

14. The exercise machine of claim 13 further including a cable assembly connecting said arms to said resistance element.

15. The exercise machine of claim 14 wherein said cable assembly includes a movable pulley rotatably mounted to each arm, a pair of guide pulleys pivotally connected to said frame, and a cable passing around said movable pulleys on said arm and said guide pulleys on said frame, wherein the movable pulleys and said guide pulleys rotate to align when said arms are moved.

16. The exercise machine of claim 15 wherein said movable pulleys each include a universal pulley mount having at least two axes of rotation for mounting said movable pulley to a respective arm.

17. The exercise machine of claim 16 wherein said resistance element comprises a weight stack.

* * * * *